United States Patent [19]

Feder

[11] Patent Number: 4,987,757

[45] Date of Patent: Jan. 29, 1991

[54] LOCK FOR CAR DOORS, IN PARTICULAR FOR TRUNK

[76] Inventor: Emil Feder, Hannoversche Str. 12, D-3501, Niestetal, Fed. Rep. of Germany

[21] Appl. No.: 360,885

[22] PCT Filed: Aug. 30, 1988

[86] PCT. No.: PCT/DE88/00526

§ 371 Date: May 4, 1989

§ 102(e) Date: May 4, 1989

[87] PCT Pub. No.: WO89/02018

PCT Pub. Date: Mar. 9, 1989

[30] Foreign Application Priority Data

Sep. 4, 1987 [DE] Fed. Rep. of Germany ..... 3729555

[51] Int. Cl.[5] ..... E05B 65/12

[52] U.S. Cl. ..... 70/240; 70/360

[58] Field of Search ..... 70/360, 361, 240, 241, 70/237

[56] References Cited

U.S. PATENT DOCUMENTS

| | | | |
|---|---|---|---|
| 2,131,033 | 9/1938 | Barrington et al. . | |
| 3,744,283 | 7/1973 | Schmidt | 70/361 |
| 4,418,554 | 12/1983 | Wolfgang | 70/361 |

FOREIGN PATENT DOCUMENTS

| | | |
|---|---|---|
| 0212364 | 3/1987 | European Pat. Off. . |
| 2854423 | 6/1980 | Fed. Rep. of Germany . |
| 2936193 | 3/1981 | Fed. Rep. of Germany . |
| 3532151 | 2/1987 | Fed. Rep. of Germany . |
| 2413521 | 7/1979 | France . |
| 2451985 | 10/1980 | France . |

*Primary Examiner*—Robert L. Wolfe

*Attorney, Agent, or Firm*—Peter K. Kontler

[57] ABSTRACT

A locking mechanism for the trunk lid of a motor vehicle has a component which assumes a first position when the trunk lid is closed and locked. The component may or may not project outward from the trunk lid in its first position. The component is capable of assuming a second position when the trunk lid is released. In the second position, the component projects outward from the trunk lid to such an extent that a portion of the component which is recessed in the trunk lid in the first position is now exposed. This portion of the component may be gripped in order to manipulate the trunk lid.

6 Claims, 1 Drawing Sheet

LOCK FOR CAR DOORS, IN PARTICULAR FOR TRUNK

BACKGROUND OF THE INVENTION

The invention relates to a lock for car doors, particularly for trunk lids.

The locks known in the art having a locking cylinder which is released relative to the lock itself by a key and, in turn, releases or arrests the arresting device of the lock relative to the chassis of the car. In order to effect the release, the locking cylinder is generally either rotated with the help of the key or is itself pushed into the lock. In the first case, the locking cylinder terminates flush with the chassis and, in the second case, the locking cylinder projects out of the chassis by a certain distance or is pushed into the chassis to the required depth.

In both cases, the locking cylinder, or the individual components which are casually or functionally connected therewith, move inside the lock from the outer surface of the chassis to the interior of the chassis and, after actuation of the arresting device, are returned to their original positions by suitable means, e.g., spring force. For cylinders which must be depressed and are not flush with the chassis in the original position, such original position, as a rule, is one in which the projecting length is that required to actuate the arresting or releasing mechanism relative to the chassis, i.e., approximately 8–15 mm beyond the outer surface of the chassis.

In a very large number of instances, the locking cylinder is, however, in the absence of another possibility, also used as a handle to close the trunk lid, particularly when this is dirty. For a lock structure with a projecting locking cylinder, the projecting part of the latter is used as a handle; for locks which require a rotation of the key or are pushed in from a flush outer surface to effect release, the inserted key is readily employed as a handle. All possible modes of use—which cannot be enumerated here because of their large number and are represented by the preceding examples—have the purpose of allowing the user to close the trunk lid without soiling himself in the event that the outer surface is dirty.

Conventional locks with their present design cannot, or can only partially, accomplish this purpose. For locks having rotating cylinders or a flush design, the user does have available a clean aid—which does not soil his hands—in the form of his key. However, the mechanical strength of a key is not selected with a view to such uses and breakage of the key with the accompanying inconvenience is very often the result. Locks with projecting locking cylinders are not available free of dirt since the projecting part is exposed to road dirt and the desired result is not achieved. While the dirty surface to be gripped is smaller than if one had to touch the trunk lid itself in order to close the same, it would nevertheless be desirable that no dirty parts need be touched.

OBJECT OF THE INVENTION

An object of the invention is to eliminate the preceding drawback. The solution is to be economical in manufacture and easily carried out.

SUMMARY OF THE INVENTION

The invention achieves this object in that the locking cylinder, contrary to its previous exclusive function, can be displaced outwards of the outer surface of the chassis beyond the normal end position and thereby present the user with a surface which was recessed in the lock housing until now and is accordingly available free of dirt.

To a certain extent, this action is present in systems whose locking cylinder does not terminate flush since the cylinder moves out beyond the outer surface of the chassis. However, the distance of outward movement is exactly equal to the distance which is required to actuate the arresting device by depression of the cylinder. Therefore, it is not sufficient for the purpose of the invention and, in addition, the cylinder itself is not available free of dirt and is thus unable to constitute an anticipation of the inventive concept.

DESCRIPTION OF PREFERRED EMBODIMENTS

Figure 1:
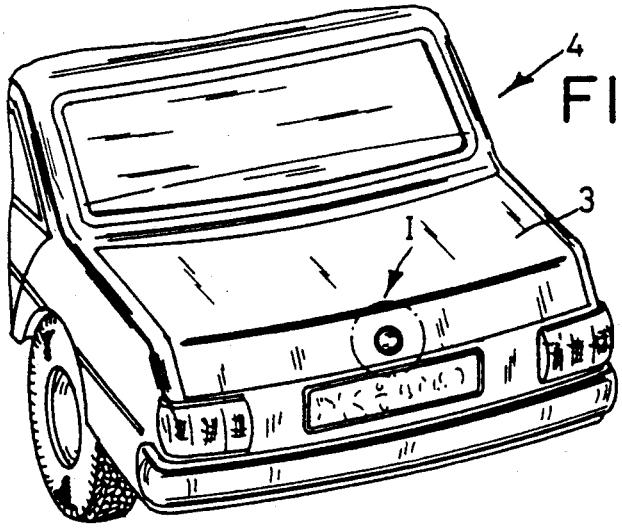
FIG. 1 is a fragmentary perspective view of a motor vehicle showing the locking cylinder of the lock for the trunk lid in a first position.
Figure 1A:
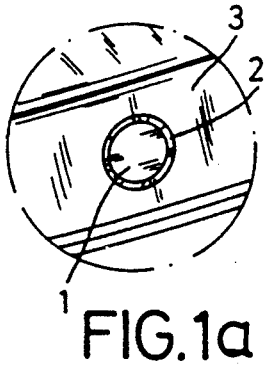
FIG. 1*a* is an enlarged view of the detail within the phantom-line circle I in FIG. 1.
Figure 2:
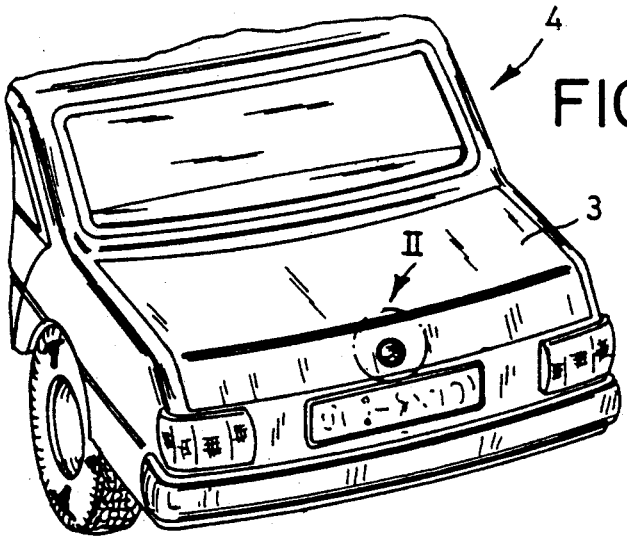
FIG. 2 is a fragmentary perspective view similar to that of FIG. 1 but showing the locking cylinder in a second position.
Figure 2A:
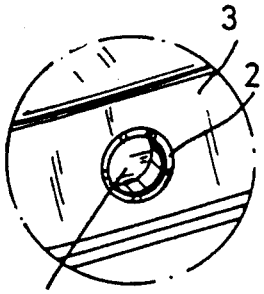
FIG. 2*a* is an enlarged view of the detail within the phantom-line circle II in FIG. 2.
Figure 3:
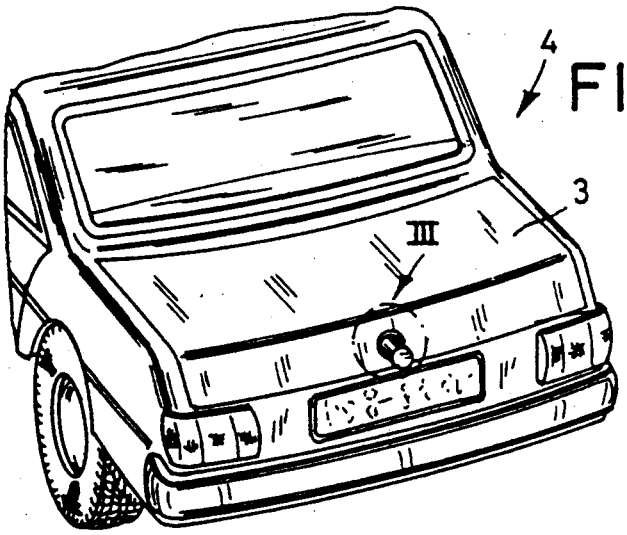
FIG. 3 is a fragmentary perspective view similar to that of FIG. 1 or 2 but showing the locking cylinder in a third position.
Figure 3A:
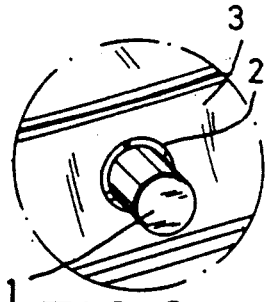
FIG 3*a* is an enlarged view of the detail within the phantom-line circle III in FIG. 3.

A lock system according to the invention, illustrated in FIGS. 1 to 3, includes a locking cylinder 1 which is provided in a trunk lid 3 of a car 4 and, via suitable means such as tracks, etc., is integrated in the lock housing 2 in such a manner that it can be drawn from its first or rest position (FIG. 1) out of the lock housing 2 counter to the release motion (FIG. 2) to thereby be available clean as an operating handle in a second position (FIG. 3). The suitable means, such as tracks, are sufficiently stable to absorb the forces used in moving the trunk lid or an equivalent door 3 without affecting the actual locking function of the locking cylinder 1.

This solution in accordance with the invention is particularly advantageous for lock systems in which the locking cylinder 1 is flush with the outer surface of the chassis or frame and release relative to the chassis occurs by turning the key or by pushing into the chassis. Thus, it is especially in these cases that, in the absence of another possibility, the key was previously often used as a handle. However, the locking cylinder can also be designed so that it projects from the chassis in its rest or normal position.

The inventive action of the locking cylinder 1 is particularly favorable when this is automatically brought into its extended position (FIG. 3) after actuation of the lock or the releasing device (FIG. 2) and automatically returns to its starting position (FIG. 1)—which is also the starting position for release—after the trunk lid 3 has been arrested. It will be understood that this movement into the extended position, as well as the return, can be performed manually by pulling out or pushing in, and combinations of the two possibilities are logically also conceivable. Similarly, many possibilities exist for mounting or guiding the locking cylinder 1 with the friction bearing constituting a preferred design. Moreover, the displacement into the withdrawn, exposed position or the starting position can be accomplished in many ways so that displacements by spring force or by hand are to be considered only as examples.

It is also conceivable to associate the locking cylinder 1 with an element or part which can be withdrawn from the lock without moving the locking unit or the locking cylinder 1 itself from its starting position, i.e., the withdrawable element is simply coupled to the locking cylinder 1 and its action either directly or indirectly. This element can completely or partially surround the locking cylinder 1 both peripherally and longitudinally. It can be provided with means which directly or indirectly perform the withdrawal or insertion function. An example would be a half shell which partially embraces the locking cylinder from above along its length and which, on the cylinder or by using the lock as a guide, can be automatically or manually brought out of the chassis into an outer position and again depressed. Further conceivable are sleeves which are only partially in the form of a half shell, or are provided with a longitudinally extending opening, and surround the locking cylinder as a sleeve. This embodiment can also be constructed so that the additional element is actuated together with the locking cylinder for the purpose of release but it alone, as part of the locking cylinder, is withdrawable from the chassis or the lock while the other part of the locking cylinder remains in its starting position and only travels its path within the chassis for release.

On the contrary, however, it is also conceivable to go the other way, namely, to associate the locking cylinder with an element or part which does not embrace it but can be withdrawn from its interior with the preceding variations and possibilities. This exemplary embodiment can, for example, be actuated by a Bowden wire from the interior of the car. It can consist of an insert which is completely or partially disposed inside the locking cylinder, i.e., is embraced by the same, both peripherally and longitudinally. This element can then also entirely assume functions of the locking cylinder, e.g., actuation of the release. In both cases—when the associated element is located outside or inside the locking cylinder—it will be understood that it is further possible for the locking cylinder to undergo movement in the interior of the chassis without the associated element following this movement.

All of the exemplary embodiments outlined above fulfill the purpose of the invention in that they serve as a lock or arresting unit and also as a closing aid which is available free of dirt.

I claim:

1. In a vehicle, a frame member; a door member movable with reference to said frame member between open and closed positions; and a lock actuatable to hold said door member in closed position, said lock having a part movable between a first position of concealment in at least one of said members in which said part is shielded against contamination and an exposed second position in which said part is accessible from the outside of the vehicle and can be used as a handle to facilitate movements of said door member between open and closed positions.

2. The structure of claim 1, wherein said lock has a locking cylinder which includes said part and is movable by hand between said first and second positions.

3. The structure of claim 1, wherein said lock has a locking cylinder which constitutes said part and is actuatable to automatically assume said second position in response to unlocking of the door member and to automatically assume said first position in response to locking of the door member.

4. The structure of claim 1, wherein said lock includes a locking cylinder and said part at least partially surrounds said locking cylinder, said part being movable with reference to said locking cylinder between said first and second positions thereof.

5. The structure of claim 1, wherein said part is movable to said second position subsequent to unlocking of the door member and to said first position subsequent to locking of said door member.

6. The structure of claim 1, wherein said lock has a locking cylinder which at least partially surrounds said part.

* * * * *